US007652219B2

(12) United States Patent
Kim

(10) Patent No.: US 7,652,219 B2
(45) Date of Patent: Jan. 26, 2010

(54) SENSORY PERCEPTION TYPE POWER SWITCH FOR A VEHICLE

(75) Inventor: Young Gyu Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 612 days.

(21) Appl. No.: 11/645,279

(22) Filed: Dec. 22, 2006

(65) Prior Publication Data

US 2008/0099319 A1 May 1, 2008

(30) Foreign Application Priority Data

Oct. 31, 2006 (KR) ..... 10-2006-0106443

(51) Int. Cl.
*H01H 13/14* (2006.01)

(52) U.S. Cl. ..... 200/521

(58) Field of Classification Search ..... 200/521, 200/81 H

See application file for complete search history.

(56) References Cited

U.S. PATENT DOCUMENTS 5,977,867 A * 11/1999 Blouin ..... 340/407.2
5,986,229 A * 11/1999 Raffoux ..... 200/521
6,121,559 A * 9/2000 Bassin ..... 200/81 H
6,327,932 B1 * 12/2001 Onodera et al. ..... 74/552
6,462,730 B2 * 10/2002 Numata et al. ..... 345/156
7,012,200 B2 * 3/2006 Moller ..... 200/11 A
2004/0060807 A1 * 4/2004 Nishimoto et al. ..... 200/553
2004/0129552 A1 * 7/2004 Nakade ..... 200/565
2009/0255793 A1 * 10/2009 Krochmal et al. ..... 200/269

FOREIGN PATENT DOCUMENTS

JP 11-120854 4/1999
JP 11-339580 12/1999
JP 11-339601 12/1999
JP 2000-082360 3/2000
JP 2003-173724 6/2003

* cited by examiner

*Primary Examiner*—Ross N Gushi
(74) *Attorney, Agent, or Firm*—Morgan, Lewis & Bockius LLP

(57) ABSTRACT

The present invention relates to a sensory perception type power switch for a vehicle perceiving the amount of change according to the respective operational state tactilely rather than visually for operating equipment such as various lamps, an air-conditioner or, a lumbar support installed in a seat back.

9 Claims, 5 Drawing Sheets

SENSORY PERCEPTION TYPE POWER SWITCH FOR A VEHICLE

CROSS-REFERENCE TO RELATED APPLICATION

This application claims priority to and benefit of Korean Patent application No. 10-2006-0106443, filed on Oct. 31, 2006, in the Korean Intellectual Property Office, the disclosure of which is incorporated herein by reference.

BACKGROUND OF THE INVENTION

1. Field of the Invention

The present invention relates to a sensory perception type power switch for a vehicle. The operator of the switch perceives the amount of change of the operational state of a lamp, an air-conditioner, a lumbar support installed in seat back, etc. being controlled tactilely rather than visually.

2. Description of the Related Art

Much electrical equipment in vehicles is operated by hand. Examples include an air-conditioner, lights, and seats.

Passengers sit on seats inside vehicles, and the seat may be composed of a seat back and a headrest mounted on the seat back.

A lumbar support may also be installed in the seat back of the seat. The lumbar support is to adjust the seat back to the body shape of the passenger, and to hold a stable pose by sticking the back of the passenger fast to the seat back.

Therefore, a controlled switch is equipped in a front side of a passenger seat to allow adjustment of the lumbar support up-and-down or front-and-rear.

That is, the lumbar support power switch of most conventional seats is configured that may be moved up-and-down or front-and-rear according to the operation of the switch knob.

However, in the lumbar support control switch, it was possible to know the amount of support of the lumbar support not by the feeling of the operator's hand but by visually.

Therefore, the driver or the operator must check lumbar support visually after adjusting the lumbar support to one's body shape, and this may distract the driver.

SUMMARY OF THE INVENTION

The present invention provides a sensory perception type power switch for a vehicle by allowing a driver to perceive the operation of various switches tactilely rather than visually.

The sensory perception type power switch for a vehicle comprises a switch knob that is manually operated by a driver, with a switch knob portion provided on each side of a separation part installed in the center of a switch housing; an air chamber that is provided with a first chamber portion and a second chamber portion, the volume of the first and second chamber portions varying according to operation of the switch knob; an air pump for feeding air into the air chamber; a control valve for controlling the air volume injected into the first and second chamber portions by the air pump; and a switch contacted by a point of contact as the air chamber into which the air is injected moves downward in the one side direction when the air is injected into the air chamber by supplying the air into one of the first/second chambers.

The sensory perception type switch knob portions are made of a hard material, and the separation part is made of a soft material.

A spring part having two springs is installed between the switch knob and the air chamber, and one end of each of the springs is installed in the lower surface of one of the switch knob portions and an opposite end of each of the springs is installed in the upper surface of the air chamber.

One spring is adjacent to the first chamber portion and one spring is adjacent to the second chamber portion.

The switch knob is provided with a convex part on one switch knob portion and a concave part on the other switch knob portion so that the driver can perceive the convex and concave parts tactilely.

It is preferable that the switch part is a push button type switch.

The sensory perception type power switch for a vehicle according to another embodiment of the present invention comprises a switch housing that is installed in a position in which a driver can operate it manually, and that has a recess formed along an upper side inner surface of the switch housing body; a switch knob that is positioned in the center of a flow part which is in contact with the upper surface of the recess so that the switch knob can move along the recess of the switch housing, the switch knob having an upper and lower side; an air chamber that is installed in the switch knob, and that is variably convex or concave-shaped with respect to the upper side of the switch knob as air is supplied into an interior of the switch knob; an air pump for feeding air into the air chamber; a switch that is installed in the lower side of the switch knob such that it can move with the switch knob; and a contact point part that is contacted according to the operation of the switch knob.

The recess is composed of a first recess that is round concave-shaped in the inner side of the switch housing in the width direction, and a second recess and a third recess that are extended to a left and a right side of the first recess, respectively, and that are contacted by the flow part when the switch knob is running.

The flow part is made of a soft material so that it may move smoothly along the recess.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Hereinafter, the sensory perception type power switch for a vehicle according to the embodiment of the present invention will be explained with reference to the accompanying drawings.

Figure 1:
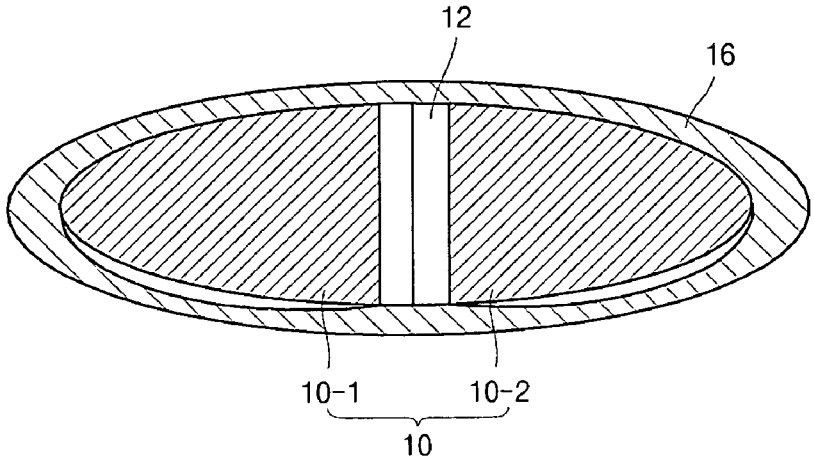
FIG. 1 is a plan view of a sensory perception type power switch for a vehicle according to the present invention.
Figure 2:
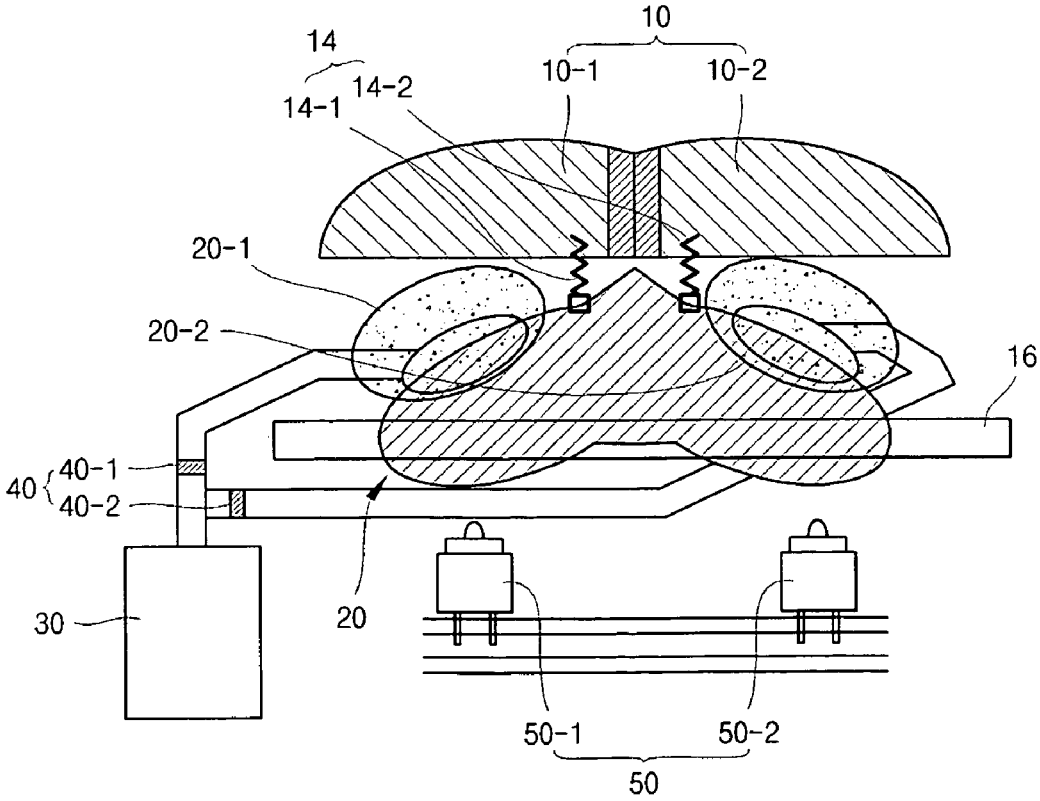
FIG. 2 is a cross-sectional view of the sensory perception type power switch for a vehicle according to an embodiment of the present invention.
Figure 3A:
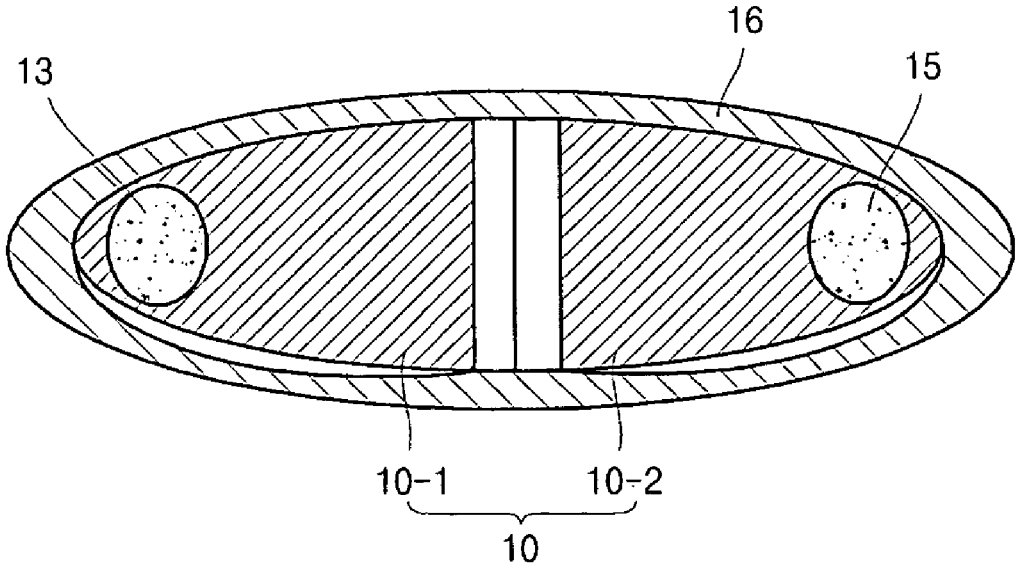
FIGS. 3*a* and 3*b* are views illustrating the sensory perception type power switch knob for a vehicle according to another embodiment of the present invention.
Figure 3B:
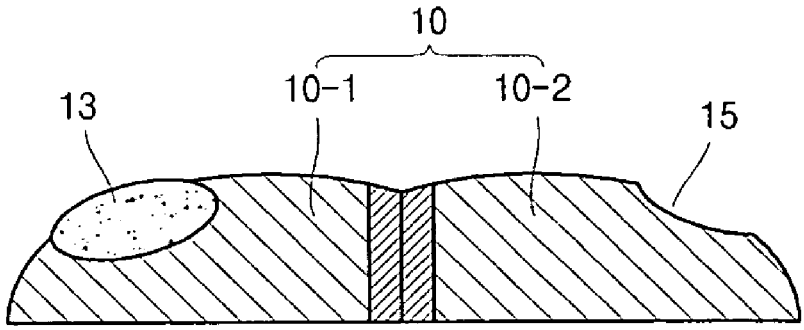
Figure 4:
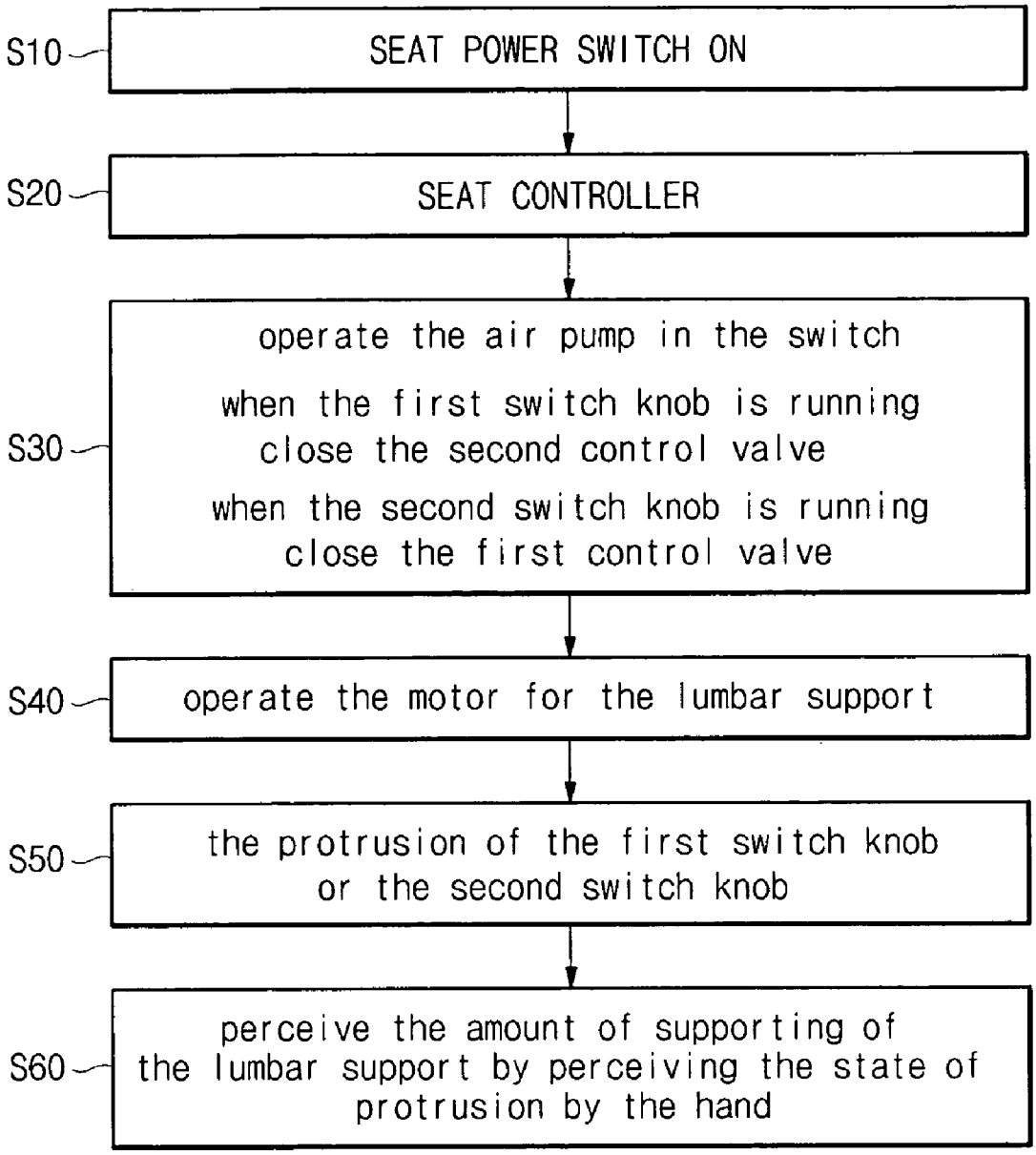
FIG. 4 is a flowchart illustrating operation of the sensory perception type power switch for a vehicle according to the present invention.
Figure 5:
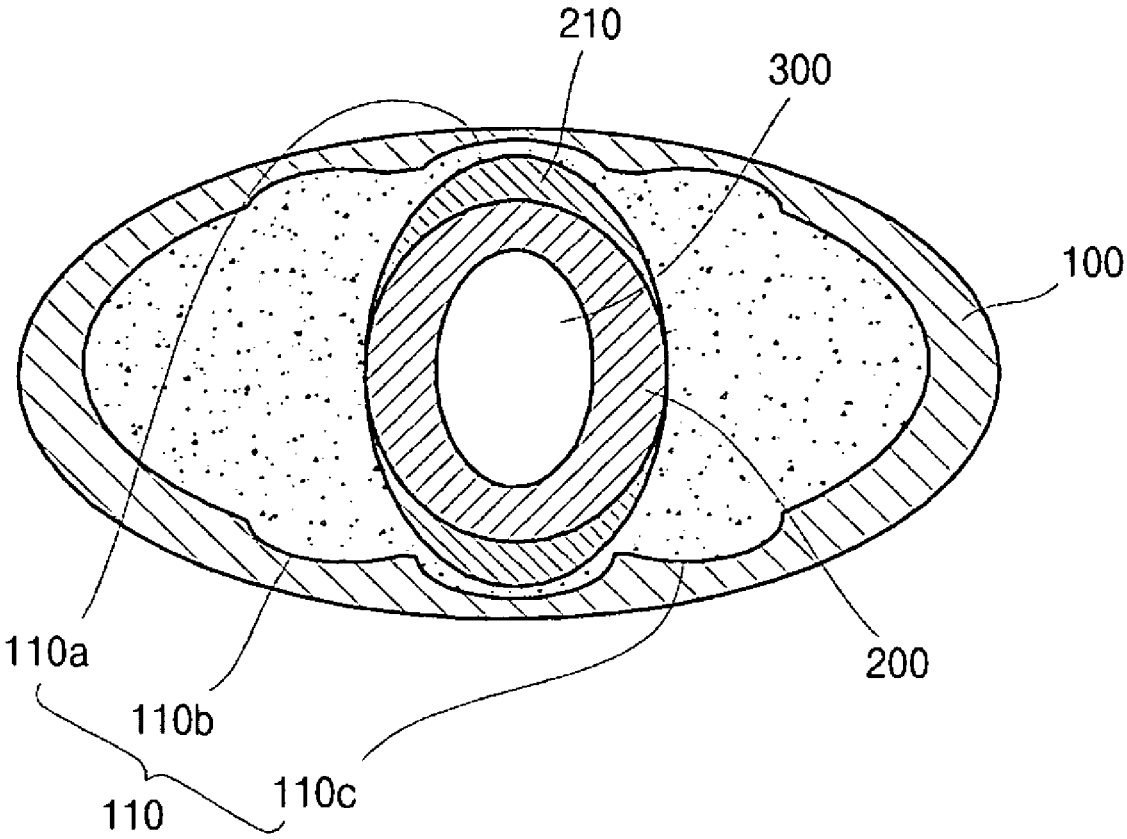
FIG. 5 is a plan view of the sensory perception type power switch for a vehicle according to another embodiment of the present invention.
Figure 6:
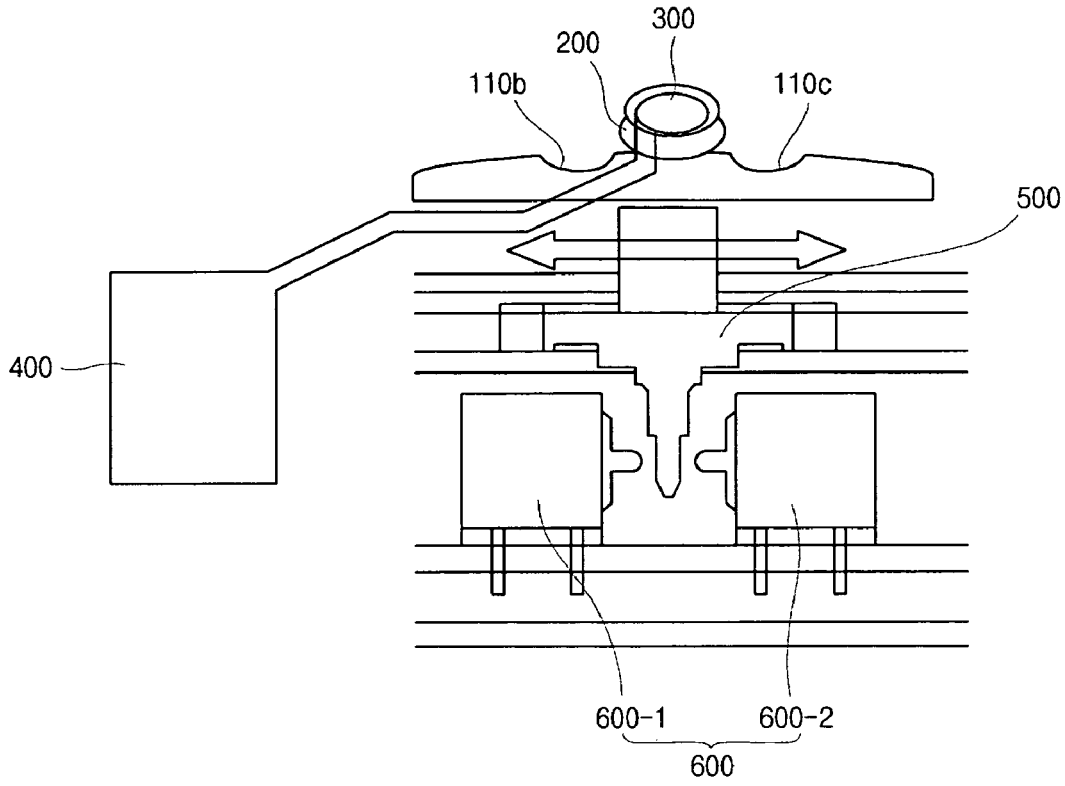
FIG. 6 is a cross-sectional view of the sensory perception type power switch for a vehicle of FIG. 5.

The attached FIG. 1 is a plan view of a sensory perception type power switch for a vehicle according to the present invention, FIG. 2 is a cross-sectional view of the sensory perception type power switch for a vehicle according to an embodiment of the present invention, FIGS. 3*a* and 3*b* are views illustrating the sensory perception type power switch knob for a vehicle according to an another embodiment of the present invention, FIG. 4 is a flowchart illustrating operation of the sensory perception type power switch for a vehicle according to the present invention, FIG. 5 is a plan view of the sensory perception type power switch for a vehicle according to an another embodiment of the present invention, and FIG. 6 is a cross-sectional view of the sensory perception type power switch for a vehicle of FIG. 5.

With reference to FIGS. 1 to 7, the sensory perception type power switch for a vehicle comprises a switch knob 10 that is manually operated by a driver with a separation part 12 installed in the center of a switch housing 16; an air chamber 20 that is provided with a first chamber 20-1 and a second chamber 20-2 so as to change an air volume according to operation of the switch knob 10; an air pump 30 feeding air into the air chamber 20; a control valve 40 for controlling the air volume injected into the first and second chamber 20-1, 20-2 by the air pump 30; and a switch 50 with a point of contact as the air chamber 20 in which the air is injected moves downward in the one side direction when the air is injected into the air chamber 20 by supplying the air into one of the first/second chambers 20-1, 20-2.

The switch knob 10 is made of a hard material, and the separation part 12 is made of a soft material. Using different materials of the switch knob 10 and the separation part 12 is to provide ease of use to the driver.

The switch knob 10 is composed of a first switch knob portion 10-1 disposed in the one side of the separation part 12, and a second switch knob portion 10-2 disposed in the other side of the separation part 12.

A spring part 14 is installed between the switch knob 10 and the air chamber 20 and both ends are installed in the lower surface of the switch knob 10 and in the upper surface of the air chamber 20, respectively. The spring part 14 is composed of a first spring 14-1 that is installed on one side under switch knob 10 adjacent to first chamber 20-1; and a second spring 14-2 that is installed on the other side under switch knob 10 adjacent to the second chamber 20-2.

As shown in FIGS. 3*a* and 3*b*, switch knob 10 is provided with a convex part 13 on switch knob portion 10-1 and a concave part 15 on switch knob portion 10-2 so that it is possible to perceive by the feeling of the driver's hand.

It is preferable that the switch part 50 is a push button type switch, and the switch part is composed of a first switch part 50-1 and a second switch part 50-2 disposed in the lower part of the air chamber 20 at intervals.

The control valve 40 is composed of a first control valve portion 40-1 installed in the nozzle connected to the first chamber 20-1, and a second control valve portion 40-2 installed in the nozzle connected to the second chamber 20-2.

As shown in FIGS. 5 and 6, a sensory perception type power switch for a vehicle according to another embodiment of the present invention comprises a switch housing 100 that is installed in a position such that a driver may operate it manually, and that has a recess 110 formed along the upper side inner surface of the switch housing body; a switch knob 200 that is positioned in the center of a flow part 210 which is surface contacted with the upper surface of the recess 110 so that it can move along the recess 110 of the switch housing 100; an air chamber 300 that is installed in the switch knob 200, and that is convex/concave-shaped into the outer/inner side of the switch knob 200, since the air is supplied into the inside as switch knob 200 moves; an air pump 400 feeding air into the air chamber 300; a switch 500 that is installed in the lower side of the switch knob 200 such that it can move with the switch knob 200; and a contact point part 600 that a point of contact is contacted according to the operation of the switch knob 200.

Recess 110 is composed of a first recess portion 110*a* that is formed in the center of the switch housing 100 and that is round concave-shaped in the inner side of the switch housing 100 in the width direction, and a second recess portion 110*b* and a third recess portion 110*c* that are extended the left/right side of the first recess 110*a* respectively, and that are surface contacted with the flow part 210 when the switch knob 200 is running.

The contact point part 600 is composed of a first contact point 600-1 and a second contact point 600-2 disposed in the front and rear parts of the switch 500 at intervals.

The flow part 210 is made of a soft material so that it may move along the recess 110 smoothly.

Operation of the sensory perception type power switch for a vehicle according to the present invention will be explained with reference to the accompanying drawings.

The sensory perception type power switch for a vehicle according to the present invention for use with equipment such as lamps, an air-conditioner, or a lumbar support installed in seat back may be installed in the vehicle in various ways, and the lumbar support will be explained for the purpose of easy explanation.

With reference to FIGS. 1 to 4, the driver seated on the driver seat turns a seat power switch on at S10 in order to adjust the angle of the seat back to the body shape of the driver. The seat controller is operated at S20 as soon as the seat power switch is on, and thus the seat back is ready to operate.

First switch knob portion 10-1 or second switch knob portion 10-2 provided in switch knob 10 is selectively operated by the driver, and for example if first switch knob portion 10-1 is pressed then second control valve portion 40-2 is closed by the pumping operation of air pump 30, and first control valve portion 40-1 is opened and air is supplied into first chamber 20-1 and thus the lumbar support is operated at S40.

Air injected into first chamber 20-1 enlarges first chamber 20-1 and extends first spring 14-1 installed in spring part 14.

Air chamber 20 is moved downwardly in the direction of first switch 50-1 as the first spring 14-1 is extended, and downwardly moved air chamber 20 presses the contact point of first switch 50-1. Wherein, first switch knob is protruded out of the switch housing 16 by the expanded first chamber 20-1.

The seat back is moved in the vertical state and supports the driver in the vertical state. Wherein, the driver perceives the first switch knob portion 10-1 tactilely rather than visually, and thus the sensory perception is accomplished.

The operation state of the second switch knob portion 10-2 is similar to that of the first switch knob portion 10-1, and thus no further explanation is described.

The sensory perception type power switch for a vehicle according to another embodiment of the present invention is explained with reference to FIGS. 3*a* and 3*b*.

With reference to FIGS. 3*a* and 3*b*, convex part 13 is formed on the tip of first switch knob portion 10-1, and thus the driver perceives the fact that the amount of supporting of the lumbar support is increased by perceiving the convex part 13 formed on the first switch knob portion 10-1 tactilely. On the other hand, the driver perceives the fact that the amount of lumbar support is decreased by perceiving the concave part 15 formed on the second switch knob portion 10-2 tactilely without checking the switch knob 10.

The operation of the sensory perception type power switch for a vehicle according to another embodiment of the present invention is explained with reference to the drawings.

With reference to FIGS. 5 and 6, according to another embodiment of the present invention, the driver seated on the driver seat perceives switch knob 200 and turns it on, wherein the driver perceives the fact that the amount of supporting of the lumbar support is a half angle when the position of switch knob 200 is positioned in first recess 110*a*, as shown in FIG. 5.

That is, the air chamber disposed in the center of switch knob 200 corresponds to a skin surface of the switch knob when switch knob 200 is positioned in first recess 110*a*, and if the driver shifts switch knob 200 in the direction of second recess 110*b*, then switch 500 is shifted to first contact point 600-1 of contact point part 600 as flow part 210 is deformed according to the shape of second recess 110*b*, and thus the switch is contacted with first contact point 600-1 and pumping by air pump 400 is accomplished.

Air pumped by air pump 400 is supplied to air chamber 300 and expands air chamber 300 to the outside of the switch knob 200. The driver knows that the lumbar support is deformed in a vertical state in advance by tactilely sensing the expansion of air chamber 300, the lumbar support is operated and the seat back is operated in a vertical state.

If the driver shifts switch knob 200 to third recess 110*c* in order to reduce the amount of supporting of the lumbar support, then the switch 500 is shifted to second contact point 600-2 of the contact point part 600 as flow part 210 is deformed according to the shape of third recess 110*c*, and thus the switch 500 is contacted with the second contact point 600-2 and the pumping by the air pump 400 is accomplished.

The air pump 400 extracts air from air chamber 300, thus shrinking air chamber 300, and the driver perceives a reduction in lumbar support by tactilely sensing contraction of the air chamber 300.

The above-described sensory perception type power switch for a vehicle according to the present invention is used as a power switch for lamps, an air-conditioner, and/or a lumbar support installed in the vehicle, and the operator perceives the amount of lumbar support tactilely rather than visually when the power switch is used to control lumbar support, and thus it increases the convenience of operation and reduces driver distraction.

As described above, the preferred embodiment of the present invention is disclosed through the descriptions and the drawings. The terms are used not to define the meanings thereof or restrict the scope of the present invention described in the claims but to explain the present invention. Therefore, it would be appreciated by those skilled in the art that changes might be made in this embodiment without departing from the principles and spirit of the invention, the scope of which is defined in the claims and their equivalents.

What is claimed is:

1. A sensory perception type power switch for a vehicle, comprising:

a switch knob that is manually operated by a driver, with a switch knob portion on each side of a separation part installed in the center of a switch housing;

an air chamber that is provided with a first chamber portion and a second chamber portion, the volume of the first and second chamber portions varying according to operation of the switch knob;

an air pump for feeding air into the air chamber;

a control valve for controlling the air volume injected by the air pump into the first and second chamber portions; and a switch contacted with a point of contact as the air chamber into which the air is injected moves downward on one side of the switch knob as air is supplied into one of the first and second chamber portions.

2. The sensory perception type power switch for a vehicle according to claim 1, wherein the switch knob portions are made of a hard material and the separation part is made of a soft material.

3. The sensory perception type power switch for a vehicle according to claim 1, wherein a spring part having two springs is installed between the switch knob and the air chamber, and one end of each spring is installed in the lower surface of the switch knob and an opposite end of each spring is installed in the upper surface of the air chamber, respectively.

4. The sensory perception type power switch for a vehicle according to claim or 3, wherein one spring is adjacent to the first chamber portion and one spring is adjacent to the second chamber portion.

5. The power switch for the sensory perception type vehicle according to claim 1, wherein the switch knob is provided with a convex part on one of the switch knob portion and a concave part on the other switch knob portion so that the driver can perceive the convex and concave parts tactilely.

6. The power switch for the sensory perception type vehicle according to claim 1, wherein the switch part is a push button type switch.

7. A sensory perception type power switch for a vehicle, comprising:

a switch housing that is installed in a position in which a driver can operate it manually, and that has a recess formed along the upper side inner surface of the switch housing body;

a switch knob that is positioned in the center of a flow part which is in contact with the upper surface of the recess so that the switch knob can move along the recess of the switch housing, the switch knob having an upper and lower side;

an air chamber that is installed in the switch knob, and that is variably convex or concave-shaped with respect to the upper side of the switch knob as air is supplied into an interior of the switch knob;

an air pump for feeding air into the air chamber;

a switch that is installed in the lower side of the switch knob such that it can move with the switch knob; and a contact point part that is contacted according to the operation of the switch knob.

8. The sensory perception type power switch for a vehicle according to claim 7, wherein the recess is composed of a first recess portion that is round concave-shaped in the inner side of the switch housing in the width direction, and second and third recess portions that are extended to a left and a right side of the first recess portion, respectively, and that are contacted by the flow part when the switch knob is running.

9. The sensory perception type power switch for a vehicle according to claim 7, wherein the flow part is made of a soft material so that it may move smoothly along the recess.

* * * * *